US007188664B2

(12) United States Patent
Fuller et al.

(10) Patent No.: US 7,188,664 B2
(45) Date of Patent: Mar. 13, 2007

(54) ALUMINUM RADIATOR TANK WITH OIL COOLER CLINCH FITTING

(75) Inventors: Chris A. Fuller, Buffalo, NY (US); Karl P. Kroetsch, Williamsville, NY (US); Joel T. Hambruch, Burt, NY (US)

(73) Assignee: Delphi Technologies, Inc., Troy, MI (US)

( * ) Notice: Subject to any disclaimer, the term of this patent is extended or adjusted under 35 U.S.C. 154(b) by 82 days.

(21) Appl. No.: 11/111,551

(22) Filed: Apr. 21, 2005

(65) Prior Publication Data

US 2006/0237174 A1 Oct. 26, 2006

(51) Int. Cl.
*F28D 7/10* (2006.01)

(52) U.S. Cl. ..... 165/140; 165/141

(58) Field of Classification Search ..... 165/133, 165/140, 141

See application file for complete search history.

(56) References Cited

U.S. PATENT DOCUMENTS

| | | | | |
|---|---|---|---|---|
| 4,094,358 | A * | 6/1978 | Neveux | 165/154 |
| 4,553,586 | A * | 11/1985 | Lardner | 165/76 |
| 4,665,972 | A | 5/1987 | Potier | 165/76 |
| 5,067,561 | A | 11/1991 | Joshi et al. | 165/140 |
| 5,113,930 | A | 5/1992 | Le Gauyer | 165/78 |
| 5,151,157 | A * | 9/1992 | le Gauyer | 165/140 |
| 5,180,005 | A | 1/1993 | Marsais et al. | 165/178 |
| 5,645,125 | A | 7/1997 | Kroetsch et al. | 165/137 |
| 5,937,938 | A | 8/1999 | Makino et al. | 165/140 |
| 6,523,605 | B2 * | 2/2003 | Doko et al. | 165/133 |
| 2005/0173099 | A1 * | 8/2005 | Nakajima et al. | 165/140 |

FOREIGN PATENT DOCUMENTS

| | | |
|---|---|---|
| EP | 0866300 A | 9/1998 |
| EP | 0889299 A | 1/1999 |
| EP | 1553377 A | 7/2005 |
| JP | 04273995 | 9/1992 |

* cited by examiner

*Primary Examiner*—Teresa J. Walberg
(74) *Attorney, Agent, or Firm*—Patrick M. Griffin

(57) ABSTRACT

The fabrication of a heat exchanger assembly by disposing a metal fitting of an oil cooler subassembly into an opening in a first tank and disposing a tubular connector into a bore in the fitting. These components are mechanically held together prior to brazing by disposing an outer clinch cylinder to extend from the fitting though the opening and by disposing an inner clinch cylinder to extend from the fitting to above an annular rib on the tubular connector and placing V-shaped first stakes in the inner clinch cylinder for mechanical engagement with the rib and placing V-shaped second stakes in the outer clinch cylinder for mechanical engagement with the first tank.

25 Claims, 3 Drawing Sheets

ALUMINUM RADIATOR TANK WITH OIL COOLER CLINCH FITTING

BACKGROUND OF THE INVENTION

1. Field of the Invention

A heat exchanger assembly and a method of fabricating a secondary heat exchanger sub-assembly in one of the tanks.

2. Description of the Prior Art

The present heat exchangers, particularly automotive radiators, often consist of a composite structure including tanks of a reinforced plastic attached to an aluminum core by crimping with gasket seals between the components. One or both of the tanks, typically the outlet tank, contains auxiliary or secondary heat exchanger sub-assemblies known as transmission oil coolers (TOC) or engine oil coolers (EOC). These heat exchanger sub-assemblies are usually fastened to the inside of the tank, e.g., by a threaded fitting extending through an opening in the tank with a nut threaded onto the fitting to sandwich a gasket seal and the tank between the nut and the fitting. Examples of such assemblies are disclosed in U.S. Pat. No. 4,665,972 to Potier; U.S. Pat. No. 5,067,561 to Joshi et al.; U.S. Pat. No. 5,113,930 to le Gauyer; U.S. Pat. No. 5,180,005 to Marsais et al.; U.S. Pat. No. 5,645,125 to Kroetsch et al.; and U.S. Pat. No. 5,937,938 to Makino et al.

Recently, more attention has been focused upon creating an all aluminum heat exchanger, e.g., an entire radiator including the tanks, to provide packaging advantages and recycling advantages with smaller tank width by eliminating the header crimp area between the core and the tanks. Whenever possible it is desirable to braze the components together rather than relying upon a mechanically held sealing connection between the components.

SUMMARY OF THE INVENTION AND ADVANTAGES

In accordance with the subject invention, a metal fitting of a secondary heat exchanger subassembly is disposed into an opening in a first tank and a tubular connector placed into a bore in the fitting. The fitting is mechanically held in engagement with the tank as the tubular connector is mechanically held in the bore of the fitting prior to brazing the metal fitting to the metal tank to seal the fitting to the tank and to brazing the fitting to the tubular connector to seal the fitting to the tubular connector.

The invention reduces the tooling and equipment required in the fabrication of an oil cooler into a metal header tank.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Figure 1:
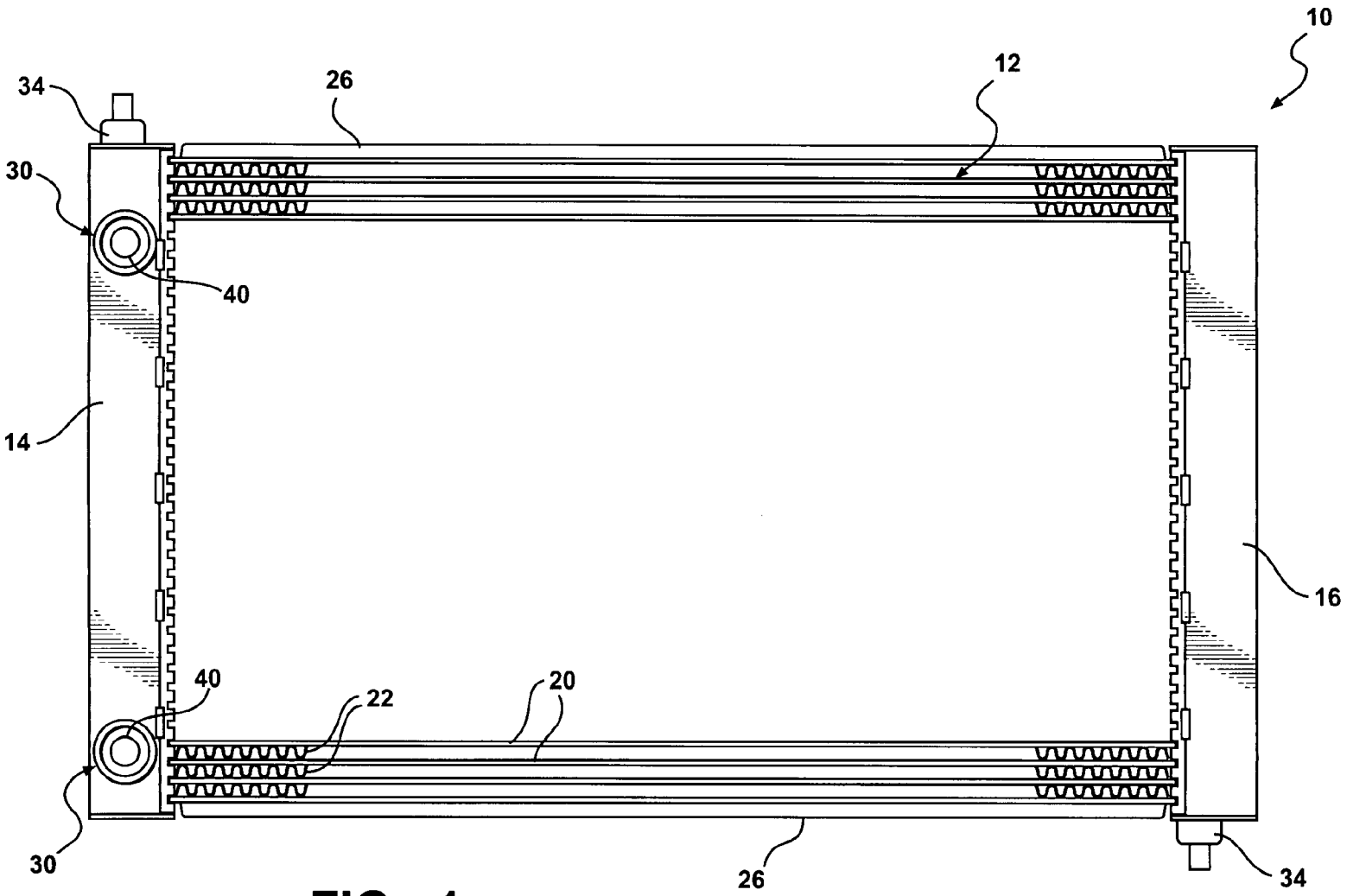
FIG. 1 is an elevational view of a heat exchanger fabricated in accordance with the subject invention.
Figure 2:
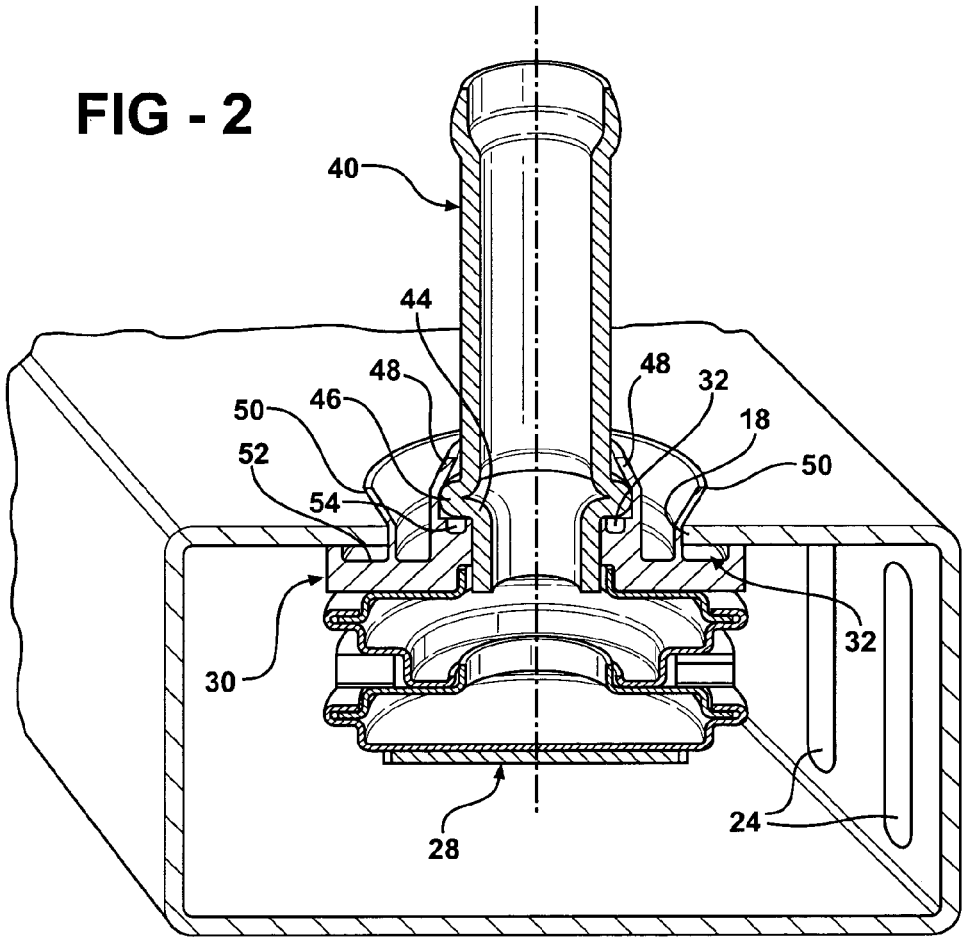
FIG. 2 is a cross sectional view of the lower fitting shown in FIG. 1.
Figure 4:
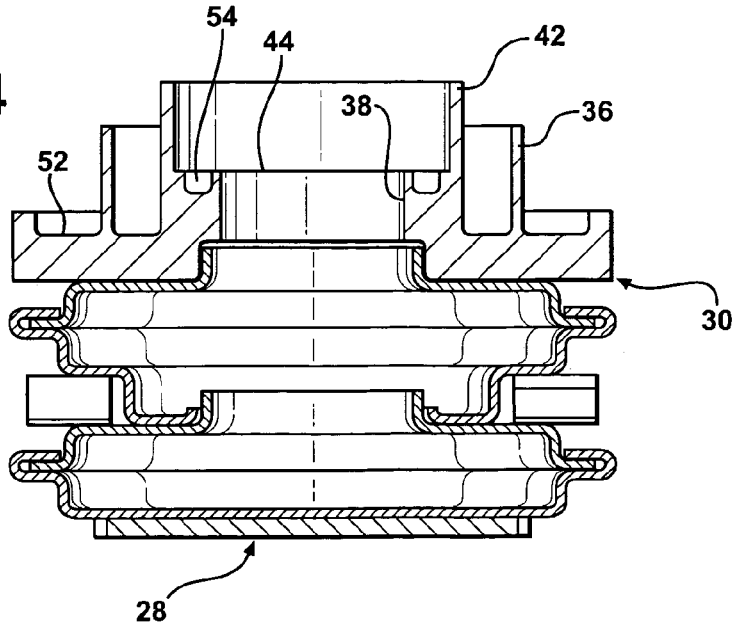
FIG. 4 is a cross sectional view of the fitting prior to insertion of the tubular connector and staking.
Figure 3:
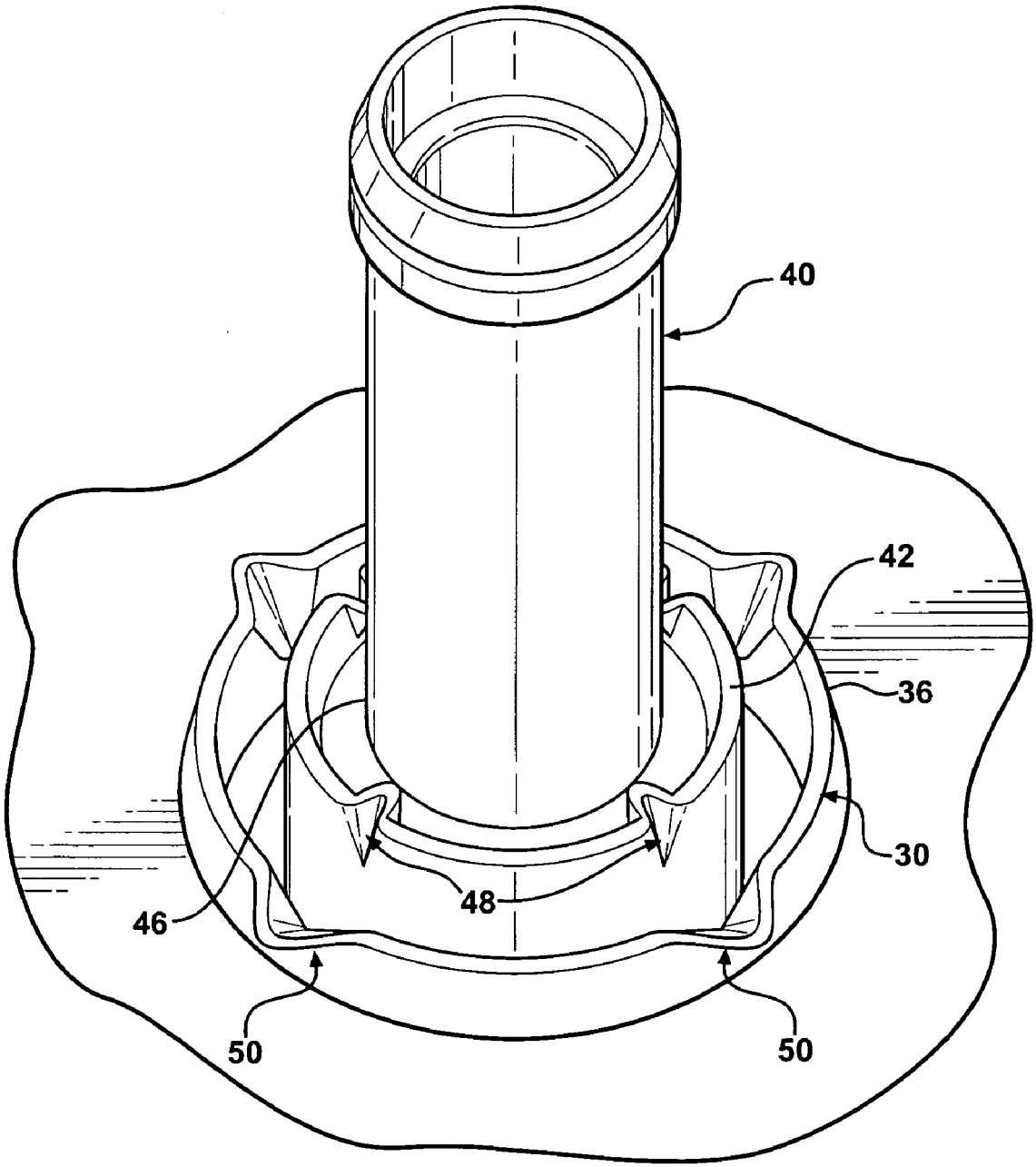
FIG. 3 is a perspective view of the fitting shown in FIG. 2.

Referring to the Figures, wherein like numerals indicate like or corresponding parts throughout the several views, a heat exchanger assembly 10 constructed in accordance with the subject invention is generally shown at in FIG. 1.

The heat exchanger assembly 10 includes a heat exchanger core 12 extending between and attached to a first tank 14 and a second tank 16 for exchanging heat with a fluid flowing between for exchanging heat with a fluid flowing between the ends thereof, i.e., between the tanks 14, 16. The first tank 14 has an opening 18. The core 12 includes tubes 20 with heat exchanger fins 22 extending between the tubes 20, as is well known in the art. The ends of the tubes 20 are inserted into slots 24 in the respective tanks 14, 16 for fluid flow between the tanks 14, 16. In addition, as is customary in the art, reinforcing members 26 extend along the sides of the core 12. A secondary heat exchanger subassembly 28, such as a transmission oil cooler, is disposed in the first tank 14 and has a pair of fluid fittings 30 for fluid communication with the subassembly 28 through the openings 18 in the first tank 14. Preferably, all of the components are made of a metal, e.g., aluminum, and at least the first tank 14 and the fittings 30 comprise metal. Many of the components are assembled and coated with a braze clad 32 at various interfaces for brazing the components in a sealing relationship with one another and particularly brazing the fittings 30 into fluid tight sealing relationship with the first tank 14. The assembly 10 also includes fluid necks 34 connected to the tanks 14, 16 for conveying coolant into and out of the tanks 14, 16.

The fittings 30 are connected to the secondary heat exchanger subassembly 28 by brazing or the like prior to being disposed in the first tank 14. The oil cooler includes a circular flange extending upwardly into an annular recess in the bottom of the fitting 30 and the prior brazing connects the oil cooler to the fitting 30 in the recess. Each fitting 30 is held in one of the openings 18 by a first mechanical connection for mechanically holding the fitting 30 in engagement with the interior of the first tank 14 about the respective opening 18. The first mechanical connection includes an outer clinch projection in the form of an outer clinch cylinder 36 extending from the fitting 30 though and past the opening 18 for deformation into mechanical engagement with the first tank 14 about the opening 18 for brazing the metal fitting 30 to the first tank 14.

Each fitting 30 has a central bore 38 and a tubular connector 40 is disposed in the bore 38 in the fitting 30 for establishing fluid communication with the secondary heat exchanger subassembly 28. The first tank 14 and the fitting 30 and the tubular connector 40 all comprise metal, metals that can be brazed together.

A second mechanical connection mechanically holds the tubular connector 40 in the bore 38 in the fitting 30 for brazing the fitting 30 to the tubular connector 40. More specifically, the second mechanical connection includes an inner clinch projection in the form of an inner clinch cylinder 42 extending from the fitting 30 for deformation into mechanical engagement with the tubular connector 40. The fitting 30 includes a seat 44 disposed about the bore 38 and the tubular connector 40 includes a radially extending rib 46 seated upon the seat 44. The inner clinch cylinder 42 surrounds the tubular connector 40 and extends to an upper rim disposed on the other side of the rib 46 from the seat 44. A plurality of first stakes 48 are spaced about the rim of the inner clinch cylinder 42 with each first stake 48 defining a radially-inwardly extending and V-shaped deformation of the inner clinch cylinder 42 that extends radially over the rib 46 of the tubular connector 40. Each V-shaped deformation defining the first stakes 48 is deformed into mechanical engagement with the rib 46 of the tubular connector 40 and there are four such first stakes 48 spaced ninety degrees apart as illustrated, although the number may vary so long as the number is sufficient to mechanically connect the tubular connector 40 to the fitting 30 to prevent relative movement there between prior to being placed in a brazing furnace for brazing. It is suggested that there be at least three first stakes 48 to prevent tilting movement of the tubular connector 40.

In a similar fashion, the outer clinch cylinder 36 includes a plurality of second stakes 50 spaced about the outer clinch cylinder 36 with each second stake 50 defining a radially-outwardly extending and V-shaped deformation of the outer clinch cylinder 36 that extends radially over the first tank 14 about the opening 18. Again, as illustrated, there are four second stakes 50 spaced equally at ninety degrees apart circumferentially about the upper periphery of the outer clinch cylinder 36 to hold the fitting 30 in the opening 18 of the first tank 14 prior to being brazed, i.e., to prevent relative movement between the fitting 30 and the first tank 14.

The fitting 30 includes a first groove 52 between the interior of the first tank 14 and the fitting 30 about the opening 18 in the first tank 14 and a second groove 54 between the rib 46 of the tubular connector 40 and the seat 44 of the fitting 30. The first groove 52 extends annularly and completely about the exterior of the outer clinch cylinder 36 in order to completely seal the fitting 30 to the interior of the first tank 14 about the opening 18, i.e., the first groove 52 is disposed radially outwardly of the outer clinch cylinder 36. The second groove 54 extends annularly and completely about the interior of the inner clinch cylinder 42 in order to completely seal the fitting 30 to the rib 46 of the tubular connector 40, i.e., the second groove 54 is disposed radially inwardly of the inner clinch cylinder 42. As alluded to above, a braze ring is disposed in the first groove 52 and in the second groove 54 for brazing the fitting 30 into fluid tight sealing relationship with the first tank 14 and for brazing and the rib 46 of the tubular connector 40 into fluid tight sealing relationship with the fitting 30.

Accordingly, the invention provides a method of fabricating a heat exchanger assembly 10 including the fabrication steps of disposing a metal fitting 30 of a secondary heat exchanger subassembly 28 into engagement with the interior of a first tank 14 about an opening 18 in the first tank 14 and disposing a tubular connector 40 into a bore 38 in the fitting 30 for establishing fluid communication with the secondary heat exchanger subassembly 28. The method of fabrication includes mechanically holding the fitting 30 in engagement with the first tank 14 about the opening 18 prior to brazing the metal fitting 30 to the first tank 14 to seal the fitting 30 to the first tank 14 to prevent fluid communication between the first tank 14 and the subassembly 28, and, at the same time, mechanically holding the tubular connector 40 in engagement with the fitting 30 in the bore 38 thereof prior to brazing the fitting 30 to the tubular connector 40 to seal the fitting 30 to the tubular connector 40. Of course, prior to simultaneously brazing the entire heat exchanger assembly 10 a heat exchanger core 12 is disposed into engagement with the first tank 14 and into engagement with a second tank 16.

The fitting 30 is mechanically held in engagement with the first tank 14 by disposing the outer clinch cylinder 36 to extend from the fitting 30 though the opening 18 for deformation into mechanical engagement with the first tank 14 as the tubular connector 40 is held in engagement with the fitting 30 by disposing an inner clinch cylinder 42 to extend from the fitting 30 for deformation into mechanical engagement with the rib 46 of the tubular connector 40. This is accomplished by disposing a seat 44 in the fitting 30 about the bore 38 and seating the rib 46 extending radially from the tubular connector 40 upon the seat 44.

The upper rim of the inner clinch cylinder 42 is disposed to extend to the other side of the rib 46 from the seat 44 and is deformed with a plurality of first stakes 48 spaced about the rim of the inner clinch cylinder 42 with each first stake 48 defining a radially-inwardly extending and V-shaped deformation in the inner clinch cylinder 42 that extends radially over the rib 46 of the tubular connector 40 so as to be deformed into mechanical engagement with the rib 46 of the tubular connector 40. In a similar fashion, the outer clinch cylinder 36 is deformed with a plurality of second stakes 50 spaced about the outer clinch cylinder 36 with each second stake 50 defining a radially-outwardly extending and V-shaped deformation in the that extends radially over the first tank 14 so as to be deformed into mechanical engagement with the first tank 14 about the exterior of the opening 18.

The fitting 30 is provided with a first groove 52 between the interior of the tank and the fitting 30 about the opening 18 and a second groove 54 between the rib 46 of the tubular connector 40 and the seat 44 of the fitting 30. The step of brazing is perfected by disposing a braze ring in the first groove 52 for brazing the fitting 30 into fluid tight sealing relationship with the first tank 14 and disposing a braze ring in the second groove 54 for brazing the tubular connector 40 into fluid tight sealing relationship with the fitting 30. The brazing of the components together is accomplished by melting the braze rings 32 to braze the fitting 30 into fluid tight sealing relationship with the first tank 14 and the tubular connector 40 into fluid tight sealing relationship with the fitting 30 so as to prevent fluid leakage between the first tank 14 and the subassembly 28.

Obviously, many modifications and variations of the present invention are possible in light of the above teachings. The invention may be practiced otherwise than as specifically described within the scope of the appended claims.

What is claimed is:

1. A heat exchanger assembly comprising:

a heat exchanger core for exchanging heat with a fluid flowing between the ends thereof, a first tank attached to said heat exchanger core having at least one opening, a second tank attached to said heat exchanger core for fluid flow through said heat exchanger between said tanks, a secondary heat exchanger subassembly disposed in said first tank, a fitting having a bore and connected to said secondary heat exchanger subassembly and extending through said opening in said first tank, a tubular connector disposed in said bore in said fitting for establishing fluid communication with the secondary heat exchanger subassembly, said first tank and said fitting and said tubular connector comprising metal, a first mechanical connection for mechanically holding said fitting in engagement with the interior of said first tank about said opening, a second mechanical connection for mechanically holding said tubular connector in said bore in the fitting for brazing said metal fitting to said first tank for brazing said fitting to said tubular connector, and a braze ring brazing said fitting into fluid tight sealing relationship with said first tank and said tubular connector into fluid tight sealing relationship with said fitting.

2. A heat exchanger assembly comprising;

a heat exchanger core for exchanging heat with a fluid flowing between the ends thereof, a first tank attached to said heat exchanger core having at least one opening, a second tank attached to said heat exchanger core for fluid flow through said heat exchanger between said tanks, a secondary heat exchanger subassembly disposed in said first tank, a fitting having a bore and connected to said secondary heat exchanger subassembly and extending through said opening in said first tank.

a tubular connector disposed in said bore in said fitting for establishing fluid communication with the secondary heat exchanger subassembly, said first tank and said fitting and said tubular connector comprising metal, a first mechanical connection for mechanically holding said fitting in engagement with the interior of said first tank about said opening, and a second mechanical connection for mechanically holding said tubular connector in said bore in the fitting for brazing said metal fitting to said first tank for brazing said fitting to said tubular connector, wherein said first mechanical connection includes an outer clinch projection extending from said fitting though said opening for deformation into mechanical engagement with said first tank about said opening and said second mechanical connection includes an inner clinch projection extending from said fitting for deformation into mechanical engagement with said tubular connector.

3. An assembly as set forth in claim 2 wherein fitting includes a seat disposed about said bore and said tubular connector includes a radially extending rib seated upon said seat, and said inner clinch projection extends from said fitting for deformation into mechanical engagement with said rib of said tubular connector.

4. An assembly as set forth in claim 3 wherein said inner clinch projection comprises an inner clinch cylinder surrounding said tubular connector and extending to an upper rim disposed on the other side of said rib from said seat.

5. An assembly as set forth in claim 4 wherein said outer clinch projection comprises an outer clinch cylinder projecting through and past said opening.

6. An assembly as set forth in claim 5 wherein said inner clinch cylinder includes a plurality of first stakes spaced about said rim of said inner clinch cylinder with each first stake defining a radially-inwardly extending and V-shaped deformation of said inner clinch cylinder that extends radially over said rib of said tubular connector.

7. An assembly as set forth in claim 6 wherein said outer clinch cylinder includes a plurality of second stakes spaced about said outer clinch cylinder with each second stake defining a radially-outwardly extending and V-shaped deformation of said outer clinch cylinder that extends radially over said first tank about said opening.

8. An assembly as set forth in claim 7 wherein said fitting includes a first groove between the interior of said first tank and said fitting about said opening in said first tank, a braze ring disposed in said first groove for brazing said fitting into fluid tight sealing relationship with said first tank.

9. An assembly as set forth in claim 7 wherein said fitting includes a second groove between said rib of said tubular connector and said seat of said fitting, a braze ring disposed in said second groove for brazing said tubular connector into fluid tight sealing relationship with said fitting.

10. A method of fabricating a heat exchanger assembly comprising the steps of;

disposing a metal fitting of a secondary heat exchanger subassembly into engagement with the interior of a metal first tank about an opening in the first tank, disposing a tubular connector into a bore in the fitting for establishing fluid communication with the secondary heat exchanger subassembly, mechanically holding the fitting in engagement with the first tank about the opening for brazing the metal fitting to the metal first tank to seal the fitting to the first tank to prevent fluid leakage between the first tank and the subassembly, mechanically holding the tubular connector in engagement with the fitting in the bore thereof for brazing the fitting to the tubular connector to seal the fitting to the tubular connector, and disposing a heat exchanger core into engagement with the first tank and into engagement with a second tank, and simultaneously brazing the entire assembly.

11. A method of fabricating a heat exchanger assembly comprising the steps of;

disposing a metal fitting of a secondary heat exchanger subassembly into engagement with the interior of a metal first tank about an opening in the first tank, disposing a tubular connector into a bore in the fitting for establishing fluid communication with the secondary heat exchanger subassembly, mechanically holding the fitting in engagement with the first tank about the opening for brazing the metal fitting to the metal first tank to seal the fitting to the first tank to prevent fluid leakage between the first tank and the subassembly, mechanically holding the tubular connector in engagement with the fitting in the bore thereof for brazing the fitting to the tubular connector to seal the fitting to the tubular connector, and brazing the fitting into fluid tight sealing relationship with the first tank and the tubular connector into fluid tight sealing relationship with the fitting.

12. A method of fabricating a heat exchanger assembly comprising the steps of;

disposing a metal fitting of a secondary heat exchanger subassembly into engagement with the interior of a metal first tank about an opening in the first tank, disposing a tubular connector into a bore in the fitting for establishing fluid communication with the secondary heat exchanger subassembly, mechanically holding the fitting in engagement with the first tank about the opening for brazing the metal fitting to the metal first tank to seal the fitting to the first tank to prevent fluid leakage between the first tank and the subassembly, mechanically holding the tubular connector in engagement with the fitting in the bore thereof for brazing the fitting to the tubular connector to seal the fitting to the tubular connector, and mechanically holding the fitting in engagement with the first tank by disposing an outer clinch projection to extend from the fitting though the opening for deformation into mechanical engagement with the first tank and mechanically holding the tubular connector in engagement with the fitting by disposing an inner clinch projection to extend from the fitting for deformation into mechanical engagement with the tubular connector.

13. A method of fabricating a heat exchanger assembly comprising the steps of;

disposing a metal fitting of a secondary heat exchanger subassembly into engagement with the interior of a metal first tank about an opening in the first tank, disposing a tubular connector into a bore in the fitting for establishing fluid communication with the secondary heat exchanger subassembly, mechanically holding the fitting in engagement with the first tank about the opening for brazing the metal fitting to the metal first tank to seal the fitting to the first tank to prevent fluid leakage between the first tank and the subassembly, mechanically holding the tubular connector in engagement with the fitting in the bore thereof for brazing the fitting to the tubular connector to seal the fitting to the tubular connector, and disposing a seat in the fitting about the bore and seating a rib extending radially from the tubular connector upon the seat.

14. A method as set forth in claim 13 further defined as mechanically holding the tubular connector in engagement with the fitting by extending an inner clinch projection from the fitting for deformation into mechanical engagement with the rib of the tubular connector.

15. A method as set forth in claim 14 including deforming the inner clinch projection into mechanical engagement with the rib of the tubular connector.

16. A method as set forth in claim 13 further defined as mechanically holding the tubular connector in engagement with the fitting by extending an inner clinch cylinder from the fitting around the tubular connector and to an upper rim disposed on the other side of the rib from the seat for deformation into mechanical engagement with the rib of the tubular connector.

17. A method as set forth in claim 16 including deforming the inner clinch cylinder with a plurality of first stakes spaced about the rim of the inner clinch cylinder with each first stake defining a radially-inwardly extending and V-shaped deformation in the inner clinch cylinder that extends radially over the rib of the tubular connector.

18. A method as set forth in claim 13 further defined as mechanically holding the fitting in engagement with the first tank by extending an outer clinch projection from the fitting and through the opening for deformation into mechanical engagement with the first tank.

19. A method as set forth in claim 18 including deforming the outer clinch projection into mechanical engagement with the first tank.

20. A method as set forth in claim 13 further defined as mechanically holding the fitting in engagement with the first tank by extending an outer clinch cylinder from the fitting and through and past the opening for deformation into mechanical engagement with the first tank about the opening.

21. A method as set forth in claim 20 including deforming the outer clinch cylinder with a plurality of second stakes spaced about the outer clinch cylinder with each second stake defining a radially-outwardly extending and V-shaped deformation in the that extends radially over the first tank.

22. A method as set forth in claim 13 including providing the fitting with a first groove between the interior of the first tank and the fitting about the opening, and disposing a braze ring in the first groove for brazing the fitting into fluid tight sealing relationship with the first tank.

23. A method as set forth in claim 13 including providing the fitting with a second groove between the rib of the tubular connector and the seat of the fitting, disposing a braze ring in the second groove for brazing the tubular connector into fluid tight sealing relationship with the fitting.

24. A method as set forth in claim 13 including providing the fitting with a first groove between the interior of the first tank and the fitting about the opening and the fitting with a second groove between the rib of the tubular connector and the seat of the fitting, and disposing a braze rings in the first groove and in the second groove for brazing the fitting into fluid tight sealing relationship with the first tank and the tubular connector into fluid tight sealing relationship with the fitting.

25. A method as set forth in claim 24 further defined as melting the braze rings to braze the fitting into fluid tight sealing relationship with the first tank and the tubular connector into fluid tight sealing relationship with the fitting.

* * * * *